US010213031B2

(12) United States Patent
Cohen

(10) Patent No.: US 10,213,031 B2
(45) Date of Patent: Feb. 26, 2019

(54) PILLOW DISPLAY STAND AND ASSEMBLY

(71) Applicant: Sourcing Network International, LLC, Bensalem, PA (US)

(72) Inventor: Randall P. Cohen, Newton, PA (US)

(73) Assignee: Sourcing Network International, LLC, Bensalem, PA (US)

( * ) Notice: Subject to any disclaimer, the term of this patent is extended or adjusted under 35 U.S.C. 154(b) by 0 days.

(21) Appl. No.: 15/062,679

(22) Filed: Mar. 7, 2016

(65) Prior Publication Data

US 2017/0251836 A1 Sep. 7, 2017

(51) Int. Cl.

| | |
|---|---|
| ***A47F 7/00*** | (2006.01) |
| ***A47F 5/04*** | (2006.01) |
| ***A47F 5/10*** | (2006.01) |
| ***A47F 5/00*** | (2006.01) |

(52) U.S. Cl.

CPC ..... *A47F 7/0007* (2013.01); *A47F 5/0018* (2013.01); *A47F 5/04* (2013.01)

(58) Field of Classification Search

CPC .. A47F 5/02; A47F 5/04; A47F 5/0018; A47F 7/0007

USPC ..... 211/27, 186, 78, 36, 144; 108/3, 6

See application file for complete search history.

(56) References Cited

U.S. PATENT DOCUMENTS 451,722 A 5/1891 Evans
766,629 A * 8/1904 Koehler ..... A47F 5/02 211/165
D51,055 S * 7/1917 Board ..... D6/677.1
1,416,566 A * 5/1922 McCleary ..... A47F 3/06 312/125
1,481,682 A * 1/1924 Buckingham ..... A47F 5/04 211/53
1,686,291 A * 10/1928 Moore ..... A47B 49/00 108/101
2,221,704 A 11/1940 Farley
2,965,429 A * 12/1960 Stanger ..... A47B 49/00 220/477
3,092,258 A 6/1963 Bleed
3,219,301 A * 11/1965 Robinson ..... A47F 5/04 206/216
3,517,905 A 6/1970 Nestegard
3,538,863 A * 11/1970 Howard ..... A47F 3/10 108/105
3,685,664 A * 8/1972 Kramer ..... A47F 5/02 108/106
3,756,421 A * 9/1973 Wilkins ..... A47F 5/02 211/163
3,788,241 A * 1/1974 Ravreby ..... A47F 7/08 108/158.12
3,827,571 A * 8/1974 Koutny ..... A47F 5/0006 206/493
3,856,370 A * 12/1974 Burrell ..... A47F 5/04 108/94

(Continued)

*Primary Examiner* — Stanton L Krycinski
(74) *Attorney, Agent, or Firm* — Connie R. Masters

(57) ABSTRACT

Display stand devices and display assemblies can be used to display and dispense a variety of consumer goods, such as substantially circular pillows. The components of the display devices and display assemblies are designed to be lightweight and disassembled for ease of transport. The disassembled components of the display devices and display assemblies can also be oriented to be substantially flat, thereby minimizing packaging material and space required during transport.

18 Claims, 8 Drawing Sheets

(56) References Cited

U.S. PATENT DOCUMENTS 3,931,894 A 1/1976 Murphy
4,126,366 A * 11/1978 Handler ..... A47F 5/02 108/152
4,379,432 A * 4/1983 Grossman ..... A47F 5/04 108/159
4,442,778 A * 4/1984 Lang ..... A47B 87/0246 108/156
D282,033 S 1/1986 Gray
4,632,474 A * 12/1986 Ingersoll ..... A47B 49/004 312/125
4,796,960 A * 1/1989 Candelas ..... A47B 77/16 312/249.13
4,842,149 A 6/1989 Vining
4,850,658 A * 7/1989 Sandor ..... A47F 5/02 211/163
4,957,206 A 9/1990 Banko et al.
4,961,506 A * 10/1990 Lang ..... A47B 87/0246 108/186
5,038,506 A 8/1991 Liljeqvist et al.
5,054,624 A * 10/1991 Camp ..... A47F 5/02 211/163
5,135,293 A * 8/1992 St-Germain ..... A47B 55/00 312/199
5,147,119 A 9/1992 Harris
D394,964 S 6/1998 Geier et al.
D401,785 S 12/1998 DePottey
D404,224 S 1/1999 Favetta
6,119,873 A * 9/2000 Matthews ..... A47F 5/04 211/196
D435,182 S 12/2000 Mason
6,443,317 B1 9/2002 Brozak, Jr.
6,585,119 B2 7/2003 Palder
D489,198 S 5/2004 Masson
D493,638 S 8/2004 Peyker
D500,417 S 1/2005 Levin et al.
D500,418 S 1/2005 Levin et al.
D504,050 S 4/2005 Vidal
6,915,914 B2 * 7/2005 Farrand ..... A47F 3/002 211/163
7,051,899 B1 5/2006 Offenhauer
D538,556 S * 3/2007 Arias ..... D6/678.1
D565,324 S * 4/2008 Sparkowski ..... D6/675.2
D565,326 S 4/2008 Warme
7,523,833 B2 * 4/2009 Zipeto ..... A47L 349/00 211/144
D596,423 S 7/2009 Opolka
7,815,048 B2 10/2010 Bean
D629,228 S 12/2010 Allman
8,079,313 B2 * 12/2011 Sparkowski ..... A47F 5/0018 108/110
D651,454 S 1/2012 Chin
D657,591 S * 4/2012 Sanchez ..... D6/675.1
8,651,299 B2 * 2/2014 Fromm ..... A47F 5/101 211/131.1
8,887,333 B2 11/2014 Cohen
D727,109 S 4/2015 Baussan
D728,963 S 5/2015 Provost
D742,143 S 11/2015 Monlun
9,332,865 B1 * 5/2016 Mason ..... A47F 5/10
D763,021 S 8/2016 Eddershaw
9,420,860 B2 * 8/2016 Jaffe ..... A45C 11/16
2005/0224431 A1 * 10/2005 Campello ..... A47F 5/02 211/52
2005/0284825 A1 * 12/2005 Goldsmith ..... A47F 3/002 211/4
2006/0169653 A1 * 8/2006 Palder ..... A47F 5/02 211/49.1
2007/0272639 A1 * 11/2007 Alexander ..... A47F 5/10 211/186
2009/0032483 A1 2/2009 Yang et al.

* cited by examiner

PILLOW DISPLAY STAND AND ASSEMBLY

FIELD OF THE INVENTION

The present invention relates to for the storing, dispensing, and displaying substantially circular consumer goods, and especially pillows. More particularly, the present invention relates to equipment for stacking substantially circular pillows such that the pillows are visible to customers and easy to dispense and reload into the device.

BACKGROUND OF THE INVENTION

Dispensing equipment is an important component in the sales of consumer goods. Display cases used to market consumer goods are preferably designed to maximize storage capacity, while ensuring that the consumer good is easily accessible to the customer. Dispensing devices are known in the art, as shown in D500,417 S, D500,418 S, and U.S. Pat. Nos. 3,517,905; 3,931,894, 3,092,258, and 5,038,506.

SUMMARY OF THE INVENTION

It is one object of the exemplary embodiments disclosed herein to provide a device that is capable of simultaneously storing, dispensing, and displaying substantially circular pillows in a manner that is space-limiting.

The display devices and display assemblies disclosed herein may be single-sided or multi-sided and are preferably designed to display substantially circular pillows. The single-sided display has a display panel, a left side, a right side, a central shelf, a display base, and a plurality of wheel assemblies. The multi-sided display assembly can house multiple single-sided displays and has a central support bar, a radial support, display panels, a base, and an outer frame. The displays and display assemblies are designed to break down into substantially flat components, such that packaging and transport is achieved more easily.

A more complete appreciation of the invention and many of the attendant advantages thereof will be readily obtained as the same becomes better understood by reference to the following detailed description when considered in connection with the accompanying drawings.

DESCRIPTION OF THE PREFERRED EMBODIMENTS

Figure 1A:
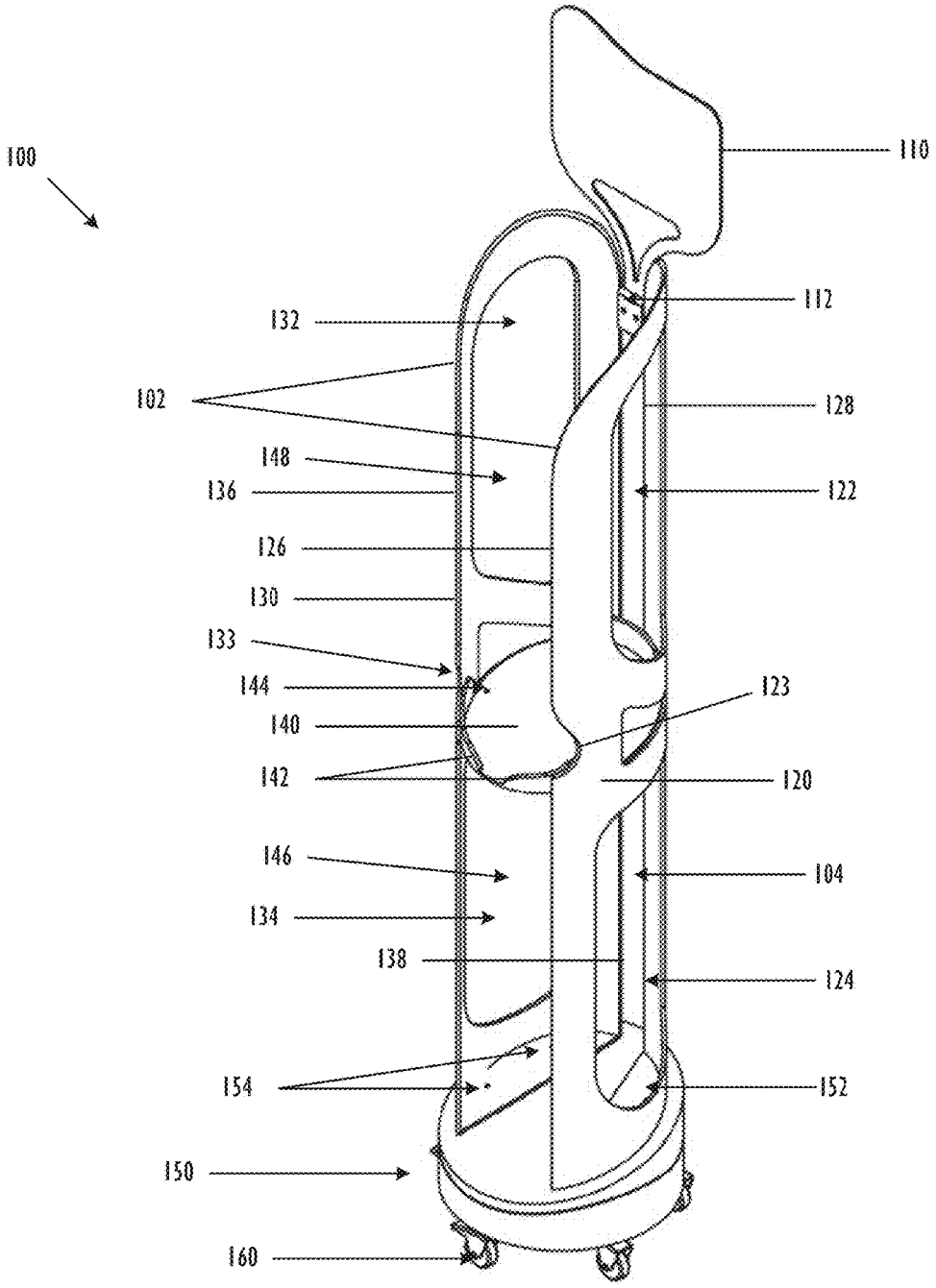
FIG. 1A shows an isometric view of single-sided display device, in accordance with an exemplary embodiment of the invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several preferred embodiments of the invention are described for illustrative purposes, it being understood that the invention may be embodied in other forms not specifically shown in the drawings.

FIG. 1A shows an isometric view of a single-sided display device 100, in accordance with an exemplary embodiment of the invention. The display device 100 can be a pillow display stand, as shown. This display device 100 has a display panel 110, a left side or left side panel 120, a right side or right side panel 130, a central or intermediate shelf 140, a display base 150, and a plurality of wheel assemblies 160. The display device 100 receives, retains, and displays consumer goods, such as pillows that are configured to fit about a person's neck, including the substantially circular (i.e., circular, oval or slightly oval) pillows, as shown in U.S. Pat. No. 8,887,333.

The display device 100 has a body that includes the left side 120 and the right side 130. The left side 120 is elongated and has a transverse cross-section that is curved to be semi-circular, so that it supports and aligns with the shape of the substantially circular pillows to be displayed. The left side 120 of the single-sided display device 100 is designed to extend substantially vertically and retain pillows at the left side of the display panel 110. The left side 120 is preferably comprised of a lightweight material such as plastic or aluminum, and is relatively thin. The left side 120 is further comprised of an upper opening 122 and a lower opening 124. The upper and lower openings 122, 124 of the left side 120 are cut out of the left side 120 or can be formed by molding. The upper and lower openings 122, 124 of the left side 120 reduce the weight of the display device 100 and enable the substantially circular pillows to be displayed and remain readily visible through the left side 120, so that product is visible from the rear or left side of the display device 100. And, the left side 120 can be transparent to increase visibility of the product. In addition, the openings 122, 124 allow the consumer to touch the product from the rear and sides of the display device 100.

Similarly, the right side 130 of the display device 100 is elongated and has a transverse cross-section that is curved to be semi-circular, so that it supports and aligns with the shape of the substantially circular pillows to be displayed. The right side 130 of the single-sided display device 100 is designed to extend substantially vertically and retain the pillows at the right side of the display panel 110. The right side 130 is preferably comprised of a lightweight material such as plastic or aluminum, and is relatively thin. The right side 130 is further comprised of an upper opening 132 and a lower opening 134. The upper and lower openings 132, 134 of the right side 130 are cut out of the right side 130 or can be formed by molding. The upper and lower openings 132, 134 of the right side 130 reduce the weight of the display device 100 and enable the substantially circular pillows to be displayed and remain readily visible through the right side 130, so that product is visible from the rear or right side of the display device 100. And, the right side 130 can be transparent to increase visibility of the product. In addition, the openings 132, 134 allow the consumer to touch the product from the rear and sides of the display device 100.

The left side 120 and the right side 130 each have a longitudinal front edge 126, 136 that come together at the front, but are spaced apart to form a front gap 102 therebetween. The left side 120 and the right side 130 also have a rear edge 128, 138 that come together at the rear and are separated by a rear gap 104 that is substantially smaller than the front gap 102. An opitional cross-member support 112 connects the rear edge 128 of the left side 120 to the rear edge 138 of the right side and spans the smaller gap 104. Together, the left side 120 and the right side 130 form a substantially cylindrical structure that mostly surrounds the substantially circular pillows. The front opening 102 between the left side 120 and the right side 130 should be sufficiently small to extend around to the front of the pillows to prevent the pillows from inadvertently falling out of the device 100. But the opening 102 should also be large enough to allow the pillows to be inserted and removed, such as by tilting the pillow at an angle or by the user pulling/pushing the pillow (which can be flexible) with a minimal amount of force to breach the opening 102.

The cylindrical structure may be split into an upper portion and a lower portion by an intermediate or central shelf 140. The central shelf 140 is connected to the left side 120 and the right side 130 to provide structural support to the substantially cylindrical frame created by the left side 120 and the right side 130. Pillows are placed on the top surface of the central shelf 140. The central shelf 140 is preferably slanted downwards at the front so that the shelf 140 (or at least a top surface of the shelf 140) is lower at the front of the device 100 and higher at the rear of the device 100. That configuration enables the shelf 140 to better display the substantially circular pillows and make it easier to insert and remove them from the display device 100.

An access 123, 133 can be provided at the front edge 126, 136 of the left and right sides 120, 130, aligned with the top surface of the shelf 140. The access 123, 133 can be a cutout that creates a widened front edge 126, 136. The access 123, 133 enables pillows to be more easily inserted and removed from the display device 100.

The central shelf 140 can optionally have a lip 142 that extends upwards from the front leading edge of the central shelf 140 and can be substantially orthogonal to the top surface of the central shelf 140. The lip 142 may be a unitary piece or, as shown in FIG. 1, may be two or more separate lips 142 with a gap(s) therebetween. The lip 142 can substantially span the entire length of the gap 102 at the front of the display device 100. In either case, the lip 142 should be sufficient in height and length to reliably function as a stop for the substantially circular pillows, such that the pillows do not inadvertently fall out of the display device 100 due to the slant of the central shelf 140. Yet at the same time, the lip 142 should not be too obtrusive as to prevent the substantially circular pillows from being effectively viewed by the consumer or render it difficult to insert and remove pillows from the display device 100. To remove a pillow, the customer can lift a pillow slightly off the central shelf 140 to align it with the access 123, 133, and then pull the pillow outward. To insert a pillow, the customer can align it with the access 123, 133 and then push it into the device 100.

The central shelf 140 (and optionally the lip 142) can have one or more attachment points 144 on either side of the central shelf 140. The attachment points 144 may be a fastener, connector, such as holes, tabs, or any other structure that allows for the central shelf 140 to be removably fastened to the left side 120 and the right side 130 such as by screws, bolts, or the like.

At the bottom of the single-sided display device 100, the left side 120 and the right side 130 are attached to a display base 150. The left side 120 and the right side 130 each have a respective bottom portion 152, 154 that is turned substantially orthogonally inwardly to be flat. The bottom portions 152, 154 are therefore better able to mate with the top surface of the display base 150 and provide support to the display device 100. Attachments can be provided at the bottom portions 152, 154 to secure the left side 120 and right side 130 to the display base 150. The attachments can be fasteners, connectors, holes, tabs, or any other structure that allows for the divider to be removably fastened to the left side 120. It is noted that a flat insert can be placed between the two bottom portions 152, 154 to provide a flat uniform surface on the base 150. The insert can be configured to have a somewhat triangular shape (with a curved bottom and cut off top) to fit in the space between the two bottom portions 152, 154.

The display base 150 has a top surface that is slanted similarly to the central shelf 140. The base 150 can also have an upturned lip to act as a stop for the substantially circular pillows, such that the substantially circular pillows do not inadvertently fall out of the display device 100 due to the slant of the slant of the display base 150. The display base 150 can be wider than the left and right sides 120, 130, to provide added stability.

Figure 1B:
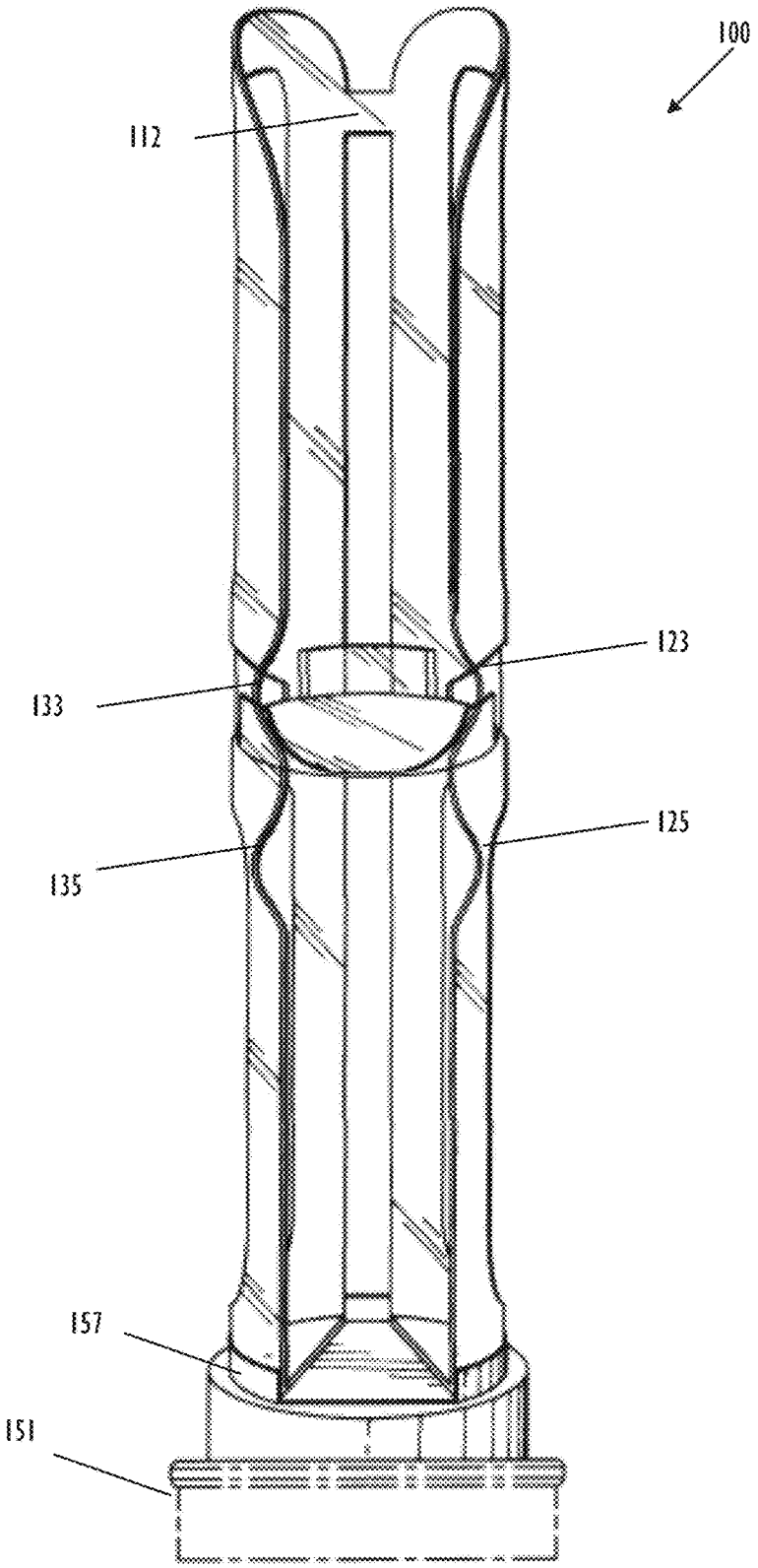
FIG. 1B shows an isometric view of a single-sided display device having an access for the bottom storage area.

FIG. 1B also shows that the base 150 can be placed atop an optional pedestal 151 to raise the device 100 and provide support to the base 150. The pedestal 151 can be circular, or can have the shape of the base 150. In addition, the base 150 or the pedestal 151 (when used) can rotate. For instance, wheels or a rotating member (such as a lazy-Susan type device). The pedestal 151 can be wider than the base 150 to provide added stability. As further illustrated in FIG. 1B, the base 150 can have a lip 157 that extends upward from the top surface of the base 150. The left and right side portions 120, 130 can fit within the lip 157, so that the lip 157 provides support to the left and right side portions 120, 130 and prevents the left and right side portions 120, 130 from inadvertently slipping off the base 150. The lip 157 can be semi-circular to match the shape and size of the left and right side portions 120, 130.

The base 150, shelf 140 and cross-member support 112 each connect to both the left side 120 and the right side 130. In this way, the base 150, shelf 140, and cross-member support 112 cooperate to provide structural support to the left and right sides 120, 130, and hold the left and right sides 120, 130 together. It should be noted that more than one shelf 140 can be provided, or that no shelf 150 needs to be provided. In addition, more than one cross-member support 112 can be utilized, or no cross-member support 112 needs to be provided.

Figure 6:
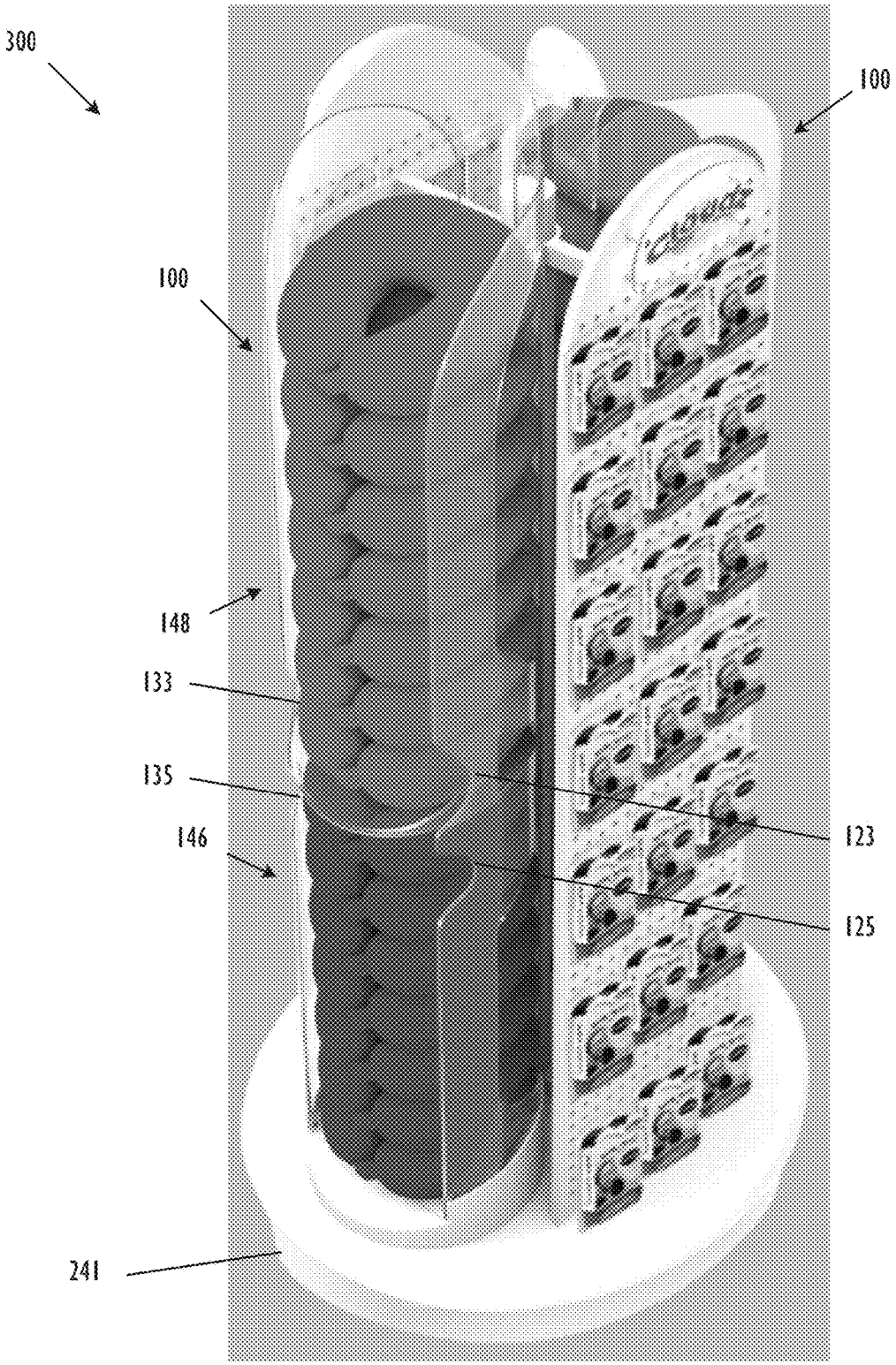
FIG. 6 shows a perspective view of a dual-directional display assembly, in accordance with another exemplary embodiment of the invention.

It is further noted that the shelf 140 defines a lower storage area 146, and an upper storage area 148. The lower and upper storage areas 146, 148 each receive one or more product (here, pillows) for storage and display, as best shown in FIG. 6. The lower storage area 146 is formed between the left and right side portions 120, 130 and below the shelf 140. The upper storage area 148 is formed between the left and ride side portions 120, 130 and above the shelf 140. The pillows in the lower storage area 146 do not contact the pillows in the upper storage area 148. So the pillows in the lower storage area 146 can be removed and inserted separately from the pillows in the upper storage area 148.

And the pillows in the upper storage area 148 can be removed and inserted separately from the pillows in the lower storage area 146.

As best shown in FIGS. 1B, 6, the device 100 can have upper accesses 123, 133 and lower accesses 125, 135. The upper accesses 123, 133 are used to facilitate insertion and/or removal of pillows contained in the upper storage area 148. Here, the upper accesses 123, 133 are at the bottom portion of the upper storage area 148. Accordingly, the bottommost pillow in the upper storage area 148 can be aligned with and inserted and/or removed through the upper accesses 123, 133. To insert a pillow into the upper storage area 148, the pillow can be aligned with the upper accesses 123, 133 and pushed into the upper storage area 148. To remove a pillow, the pillow is aligned with the upper accesses 123, 133 and pulled outward. Pillows can also be added or removed through the top opening of the upper storage area 148. Pillows can also be turned sideways slightly to fit within the front gap 102.

The lower accesses 125, 135 are used to facilitate insertion and/or removal of pillows contained in the lower storage area 146. Here, the lower accesses 125, 135 are at the top portion of the lower storage area 146. Accordingly, the topmost pillow in the lower storage area 146 can be inserted and removed through the lower accesses 125, 135. To insert a pillow into the lower storage area 146, a pillow is aligned with the lower accesses 125, 135 and pushed in through those lower accesses 125, 135, then dropped into the lower storage area 146. To remove a pillow from the lower storage area 146, the topmost pillow is aligned with the lower accesses 125, 135 and pulled outward. Pillows can also be turned sideways slightly to fit through the front gap 102.

As further illustrated in FIG. 1, an optional display panel 110 can be provided. The display panel 110 can be shaped as a rectangle and may be slightly curved to more optimally display the identity of the product being sold. For example, the display panel 110 allows for a sign or sticker to be fastened thereto, such that a customer may readily determine the contents of the display device 100. The display panel 110 has an elongated neck that attaches to the cross-member support 112 (which also attaches to the left side 120 and the right side 130 of the single-sided display device 100). Or, the display panel 110 can be integral with the cross-support member 112.

Figure 2:
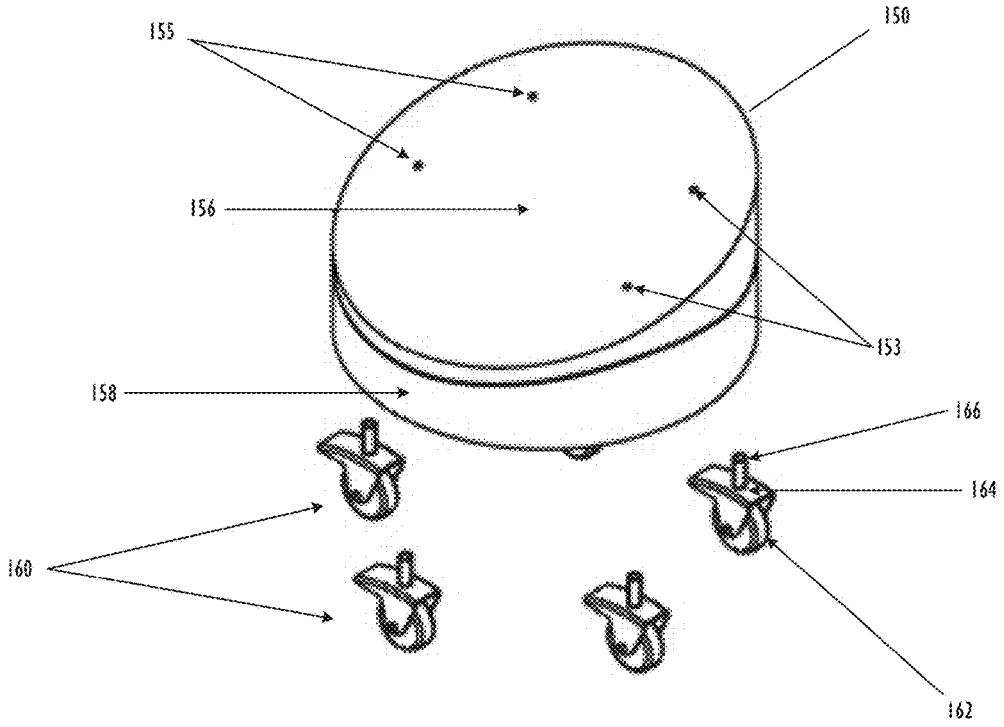
FIG. 2 shows an exploded view of the wheel base of single-sided display device, in accordance with an exemplary embodiment of the invention.

Referring now to FIG. 2, the display base 150 and the wheel assemblies 160 are shown in greater detail. The display base has one or more attachment points 153, 155 for removably fastening the bottoms 152, 154 of the left side 120 and right side 130 to the base 150. These attachment points are shown as machined or drilled holes in the top surface 156 of the display base 150. The top surface 156 is slanted to allow substantially circular pillows to be inserted and removed. The outer circumference 158 can be a rubberized material, such that the display base 150 is protected from collision damage.

A plurality of wheel assemblies 160 may also be removably attached to the bottom of the display base 150, such that the single-sided display device may be easily moved while assembled. The wheel assemblies are comprised of a caster wheel 162, a frame 164, and an attachment plate 166. The wheel assemblies are multi-directional, because the wheel 162 and the frame 164 are able to rotate freely about their vertical axis. In this manner, the display base 150 is able to be easily moved in any direction.

All of the components of the display device 100 are separate discrete elements, including the left side 120, right side 130, shelf 140, base 150, and display panel 110. When separate, those components are relatively flat (even though the sides 120, 130 are curved, they can sit one inside the other), and are easy to package and ship. The display device 100 can then be assembled on-site at a retail store or the like. To assemble the device 100, the wheel assemblies 160 are fastened to the base 150. The sides 120, 130 are then stood upright on the top surface of the base 150 and fastened thereto. The shelf 140 and cross-member support 112 are then attached, such as by fasteners. Once assembled, the display device 100 can be broken down by separating those elements for further storage and or transportation. Furthermore, since each of the foregoing components of the display device 100 are substantially flat, shipping of the display device 100 is easier. Among the benefits afforded by the substantial flatness of the disassembled components are ease of boxing and unboxing of the display device 100, as well as a reduction in the amount of shipping space required for transport. However, it will be readily apparent that some or all of the components of the device 100 can be made integral, so that the sides 120, 130, shelf 140, base 150, and/or the optional display panel 110 are one-piece.

Figure 3:
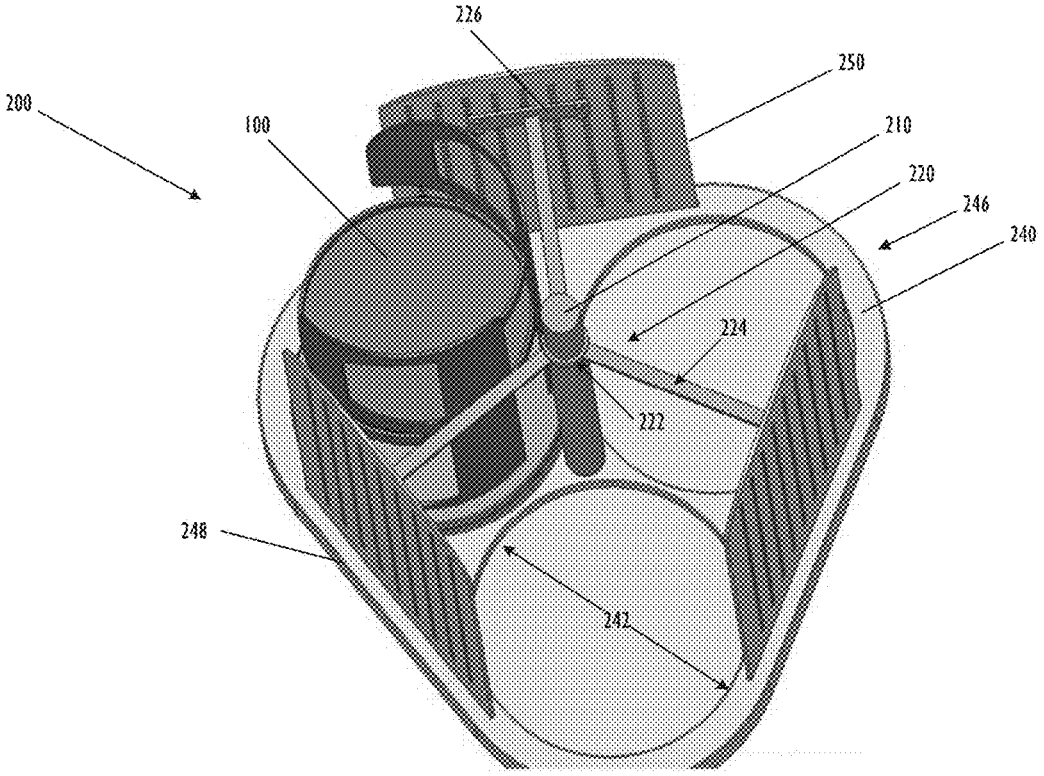
FIG. 3 shows a top view of a three-sided display device, in accordance with an exemplary embodiment of the invention.
Figure 4:
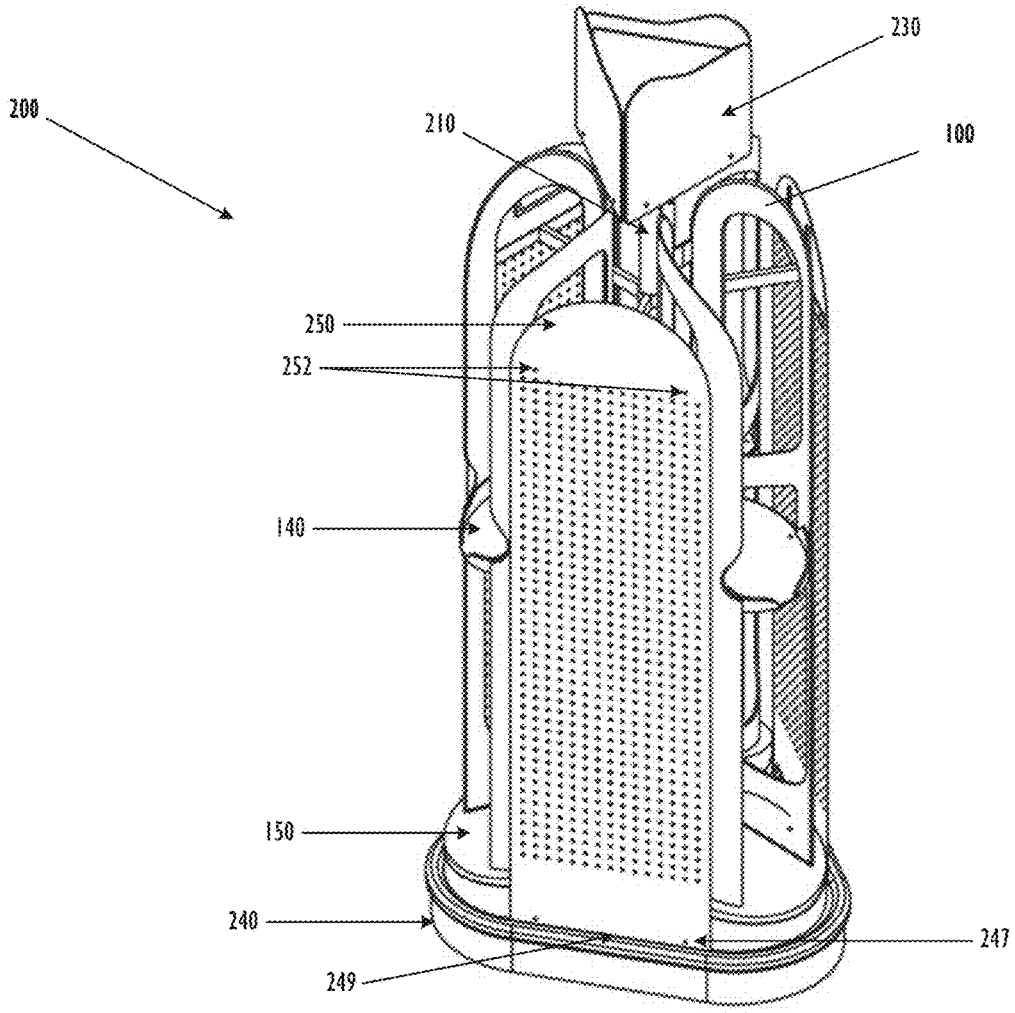
FIG. 4 shows an isometric view of a tri-directional display assembly, in accordance with an exemplary embodiment of the invention.
Figure 5:
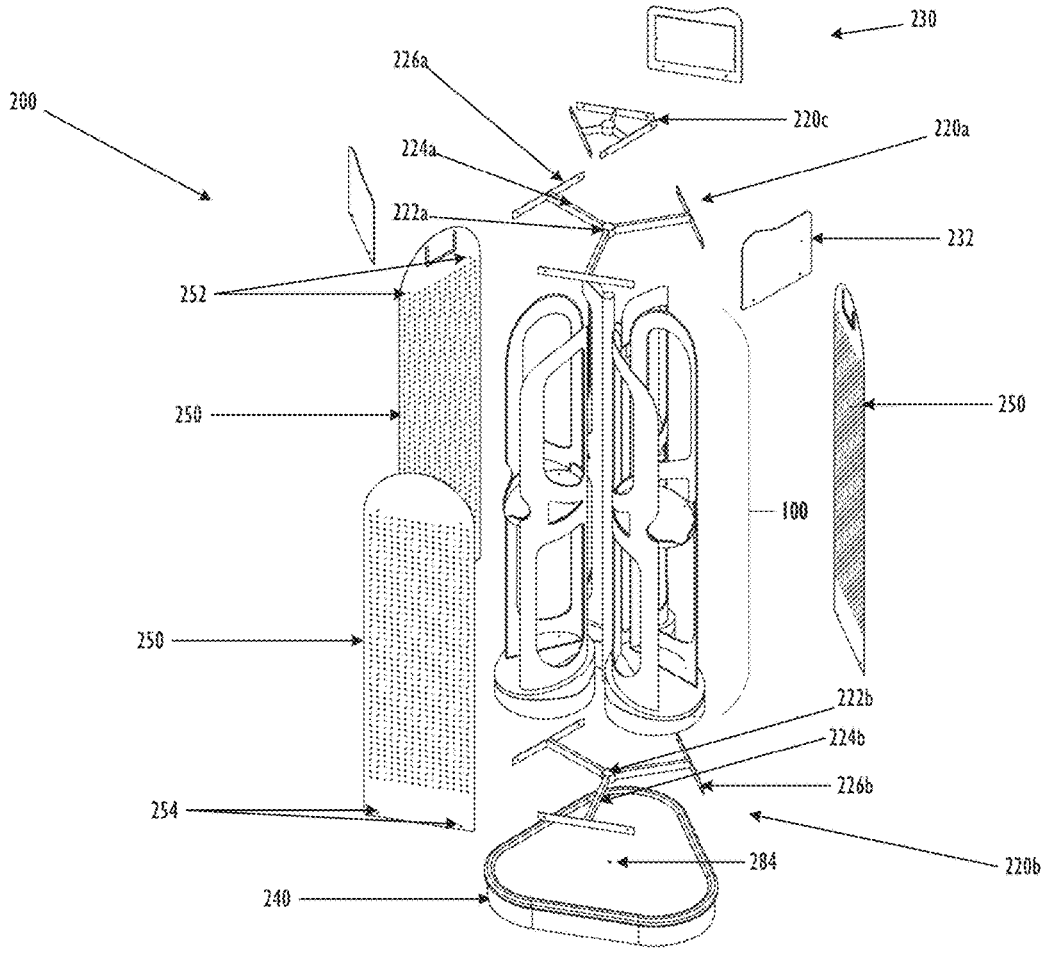
FIG. 5 shows an exploded isometric view of a tri-directional display assembly, in accordance with an exemplary embodiment of the invention.

FIGS. 3-5 show an alternative embodiment of the invention, where a plurality of single-sided display devices 100 (without wheel assemblies) are incorporated into a frame, to form a tri-directional display assembly 200. The tri-directional display assembly may include from one to three of the single-sided display device 100, as shown and described with respect to FIGS. 1 and 2. The tri-directional display assembly 200 is designed to allow for the display of the substantially circular pillows in multiple (three in the embodiment of FIG. 3) directions, but it will be readily apparent to one of ordinary skill in the art that any polygonal configuration may be applied to the frame to form a multi-directional display assembly. A useful characteristic of the components described herein is that they are removably attached to each other and substantially flat, such that the disassembled tri-directional display 200 may be shipped flat.

The tri-directional display assembly 200 is principally comprised of a central support post 210, a radial support assembly 220, a plurality of display panels 230, a bottom or bottom plate 240, and one or more outer screens 250. The central support post 210 extends vertically from about the center of the bottom plate 240 along the length of the tri-directional display assembly. The central support post 210 may be formed out of a lightweight metal such as aluminum (or an alloy of such a lightweight metal), or from a plastic. The central support post 210 may be cylindrical, as shown, or shaped as any three-dimensional prism that is able to extend the length of the tri-directional display assembly 200, while passing substantially medially through its components.

The radial support assembly 220 is slidably and removably connected to the post 210. The radial support assembly 220 has a circular connect member 222 and one or more elongated radial support arms 224. The radial support arms 224 extend radially outward from the central connect member 222. The central circular member 222 is slidably received on the central support post 210. A fastening plate 226 is located at the distal end of each of the arms 224, and the circular connect member 222 is connected at the proximal end of each of the arms 224. Each fastening plate 226 is substantially orthogonal to the respective arm 224. The fastening plate 226 can be elongated and in the exemplary embodiment shown, can be rectangular.

The bottom plate 240 has a plurality (three in the embodiment shown) of recessed portions 242 that each receive one of the display devices 100 (FIGS. 1-2). When the display devices 100 are positioned in the recessed portion 242, the substantially circular pillows loaded into those display devices 100 are accessible and removable. The recesses 242 are of substantially the same shape as the base of the single-sided display device 100 and are evenly spaced such that the tri-directional display assembly 200 is symmetrical. In the embodiment of FIG. 3, the bottom plate 240 is substantially triangular, with curved corners 246 and straight sides 248, and a recessed portion 242 is located at each of the respective corners, with the central post 210 therebetween.

As further shown in FIG. 3, a plurality of product display panels or screens 250 are provided. The screens 250 are flat and elongated and stand vertically upright on the display assembly 200. The screens 250 can be received in elongated slots in the bottom plate 240. The elongated slots support the screens 250 and prevent the screens 250 from inadvertently slipping with respect to the bottom plate 240. The screens 250 are fastened (by screws, bolts, etc.) to the fastening plate 226 of the respective support arms 224 through holes 252, 254, and the support arms 224 extend between neighboring display devices 100. Thus, the screens 250 are located at the straight sides 248 of the bottom plate 240, and are positioned between the display devices 100, so that the display devices 100 alternate with the screens 250.

As shown in the alternative embodiment of FIG. 5, the display assembly 200 can have an upper support assembly 220*a* and a lower support assembly 220*b*. The central support post 210 passes through the center of the upper support 220*a*, through the lower support 220*b*, and downwards to connect with the base 240. The upper support 220*a* and the lower support 220*b* are substantially similar to each other and the radial support 220 (FIG. 3), and have a connect member 222*a*, 222*b*, radial support arms 224*a*, 224*b*, and fastening plate 226*a*, 226*b*. The upper support assembly 220*a* removably connects to the screens 250 at the middle or top of the screens 250, such as by a fastener (screw or bolt). The lower support assembly 220*b* removably connects to the screens 250 at the bottom of the screens 250, such as by a fastener (screw or bolt). In this embodiment, the bottom plate 240 need not have recessed portions. So, the lower support assembly 220*b* can rest on the bottom plate 240 to define separate areas on the bottom plate 240 at which the display devices 100 are received on the bottom plate 240, and to separate the display devices 100.

As further shown in FIGS. 4-5, the bottom plate 240 need not have recessed portions as in FIG. 3, but instead can have an upright retention lip 249. The retention lip 249 extends about the entire outer periphery of the bottom plate 240 and extends upward therefrom. The retention lip 249 prevents the outer screens 250 from sliding off of the bottom plate 240. As will be appreciated, the lip 249 need no extend around the entire outer periphery of the bottom plate 240, but can be provided along portions where the screens 250 are received on the bottom plate 240.

As shown in FIGS. 4-5, an optional forward-facing display panel assembly 230 can be provided at the top of the post 210. The forward-facing panel assembly 230 can be used to display information about the items, such as substantially circular pillows, that are loaded into the tri-directional display assembly 200. The forward-facing panel assembly 230 includes a radial support assembly 220*c* that is similar to the radial support assembly 220 of FIG. 3, including a circular connect member 222*c*, radial arms 224*c*, and fastening plate 226*c*. The forward-facing display panels 232 are fastened (screw, bolt, etc.) to the fastening plate 226*c*, and can display a message such as an advertisement or information about the product on display. The display panels 232 can collectively form a substantially triangular shape. The display assembly 230 is positioned at the top of the post 210, so that the display panels 232 are above the screens 250 and easily visible to consumers. The radial support assembly 220 (FIG. 3), 220*a*, 220*b* (FIG. 5) can be much wider than the radial support assembly 220*c*.

The tri-directional display assembly 200 can dispense product from each of the display devices 100. And information be displayed on the screens 250, or other product can be attached to the screen 250 for display. For instance, the screen 250 can have a plurality of holes (as shown) and mounting devices can be attached to some of the plurality of holes to hold product (see FIG. 6). The display assembly 200 maximizes the available space by having product displayed on the display devices 200, and providing the screens 250 at the otherwise unused space between the display devices 100 (to the sides and rear). The display devices 100 all face outward so that product can be easily seen, inserted and removed. Accordingly, the display devices 100 each face in different directions so that product can be dispensed from all about the display assembly 200. It will also be appreciated that the screens 250 and the display devices 100 have separate utility; so the screens 250 can be used without the display devices 100 and the display devices 100 can be used in the assembly 200 without the screens 250.

As in the case of the display device 100, all of the components of the tri-directional display assembly 200 are separate discrete elements, including the post 210, radial support assembly 220, bottom plate 240, screens 250, left side 120, right side 130, shelf 140, base 150, and display panel 110. When separate, those components are relatively flat (even though the sides 120, 130 are curved, they can sit one inside the other), and are easy to package and ship. The display assembly 200 can then be assembled on-site at a retail store or the like. To assemble the display assembly, the display devices 100 are assembled as described with respect to FIGS. 1-2 above, except that the wheel assemblies are not applied. The radial support assemblies are placed on the post 210 and the post 210 is attached to the bottom plate 240. The support assembly 220 (or 220*a*, 220*b*) is raised to the desired position, and the screens 250 are attached to the fastening plates 226. The display devices 100 are then placed on the bottom plate 240, either in the recesses or between the lower support assembly 220*b*. The support assembly 220 (or 220*a*, 220*b*) support the screens 250 on the bottom plate 240 and keep them in an upright position.

Once assembled, the display assembly 200 can be broken down, so that transportation and re-assembly of the tri-directional display assembly 200 is made easier. Furthermore, since each of the foregoing components of the tri-directional display assembly 200 are substantially flat, shipping of the tri-directional display assembly 200 is easier. Among the benefits afforded by the substantial flatness of the disassembled components are ease of boxing and unboxing of the tri-directional display assembly 200, as well as a reduction in the amount of shipping space required for transport. It will be readily apparent that some or all of the components of the display assembly 200 can be made integral, so that the post 210, support assemblies 220, bottom plate 240, screens 250, sides 120, 130, shelf 140, base 150, and/or the optional display panel 110 are one-piece.

Figure 7:
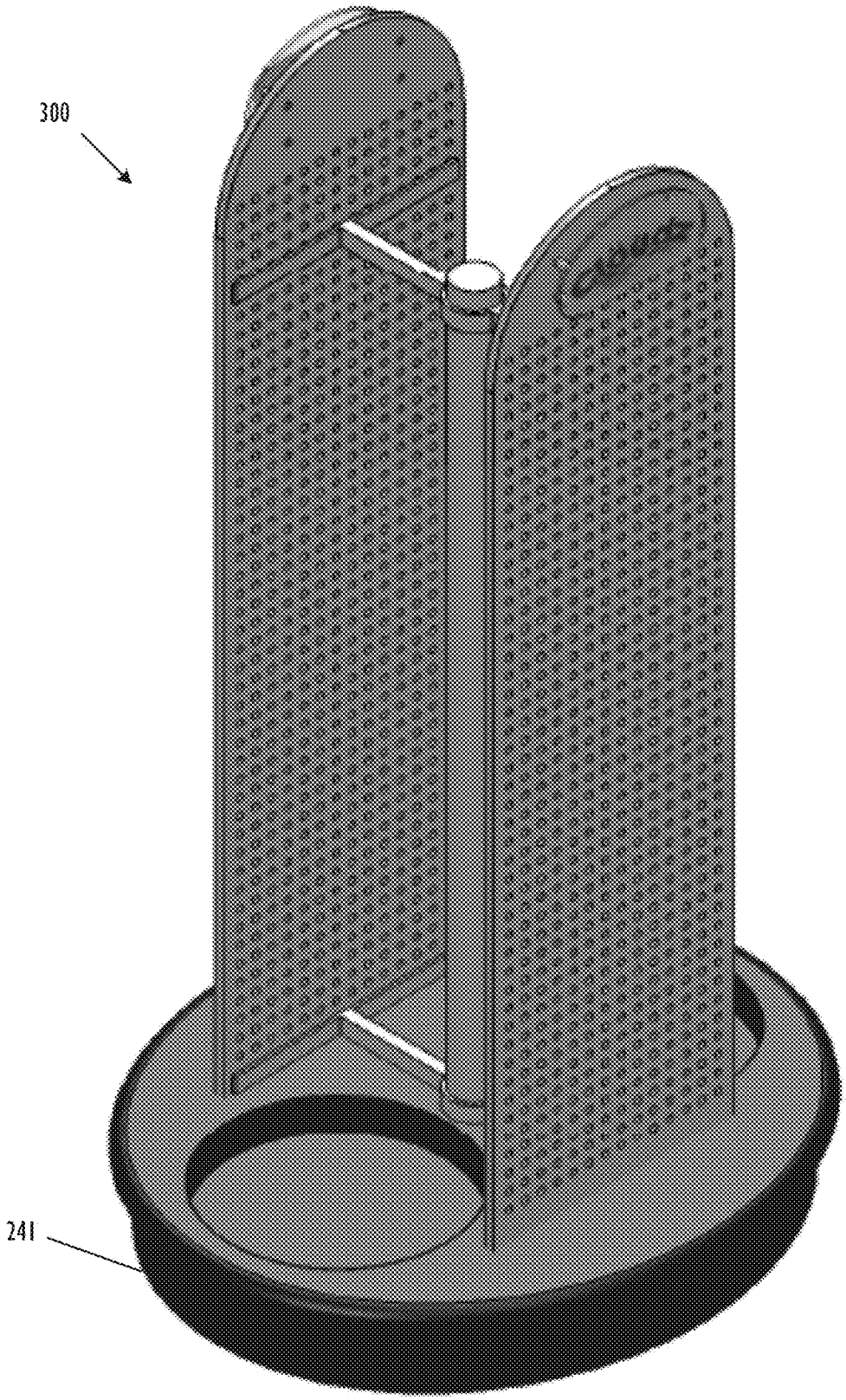
FIG. 7 shows a view of the display assembly of FIG. 6, without the display stand devices.

Still another embodiment of the invention is shown in FIGS. 6-7. Here, a display assembly 300 is shown that has two single-sided display devices 100 (of FIGS. 1A-1B, without the optional wheels or pedestal 151). The bottom plate 240 can have an oblong shape, with the display devices 100 received at opposite lateral ends (corners) of the oblong shape. FIG. 6 also shows that the bottom plate 240 can be placed atop an optional pedestal 241 to raise the assembly 300 and provide support to the bottom plate 240. The pedestal 241 can be circular, or can have the shape of the bottom plate 240. In addition, the bottom plate 240 or the pedestal 241 (when used) can rotate. For instance, wheels or a rotating member (such as a lazy-Susan type device). The pedestal 241 can be wider than the bottom plate 240 to provide added stability.

As shown in the dual-sided assembly 300, the display devices 100 face in opposite directions with the rear sides of the display devices 100 facing each other at the center of the assembly 300 and the front sides facing away from each other in opposite directions. The screens 250 extend on the long sides of the bottom plate 240, along the sides of the display devices 100. Thus, the display devices 100 are at the lateral sides of the assembly 300 and face outward in opposite directions from each other. And the screens 250 are at the longitudinal sides of the assembly 300 and face outward in opposite directions from each other. The display devices 100 face substantially orthogonally to the screens 250.

The invention in the non-limiting illustrative embodiments of the three-sided assembly configuration (FIGS. 3-5) is triangular in shape and the dual-sided assembly configuration (FIGS. 6-7) is oblong in shape. However, it will be appreciated that the display assembly 200 (e.g., the bottom plate 240) can have any suitable shape with two or more pointed or rounded corners, such as being oblong, triangular, square, rectangular, pentagon, trapezoid, etc., which can respectively house or receive two or more display devices 100. The display devices 100 can be positioned at the corners (in recessed portions 242 (FIG. 3) or just within an upright retention lip 249 (FIGS. 4-5)), and the screens 250 positioned at the straight sides between the display devices 100. Of course, the display devices 100 do not be positioned at the corners, but can be positioned at straight sections.

In addition, the invention has been shown and described where a support arm(s) 224 connects to each of the screens 250. However, a support arm(s) 224 can also connect to the display devices 100. Each support arm 224 can connect, for instance, to the cross-member support 112 and/or to the left and right side potions 120, 130. More than one arm 224 can be provided for each display stand 100, and for instance an arm 225 can be provided at each of the top, bottom and/or middle of the display stand 100. The arms 224 would connect to the central pole to provide further stability and support to the device 100.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. A display device comprising:

a round base having a slanted top surface to form a bottom shelf, said base having a front base portion, a rear base portion, a left side base portion, and a right side base portion;

an elongated discrete left side extending uniformly upward from said round base, said elongated left side having a transverse cross-section that is curved to substantially conform to a shape of the round base and extend from the left side base portion to the rear base portion;

an elongated discrete right side separate from said left side and extending uniformly upward from said round base, said elongated right side having a transverse cross-section that is curved to substantially conform to the shape of the round base and extend from the right side base portion to the rear base portion; and a round intermediate shelf coupled to the elongated left side and coupled to the elongated right side, said round intermediate shelf having a slanted top surface;

wherein the elongated left side and the elongated right side form a partial enclosure about the round intermediate shelf and the bottom shelf that extends about the left base portion, rear base portion, and right base portion, whereby the elongated left side and the elongated right side are configured to retain products stored on the bottom shelf and the round intermediate shelf.

2. The display device of claim 1, wherein the round base and the round intermediate shelf are coupled to the elongated left side and the elongated right side by removable connectors.

3. The display device of claim 2, wherein the elongated left side is configured to sit inside the elongated right side in a disassembled state.

4. The display device of claim 1, wherein a first portion of a gap between the elongated left side and the elongated right side is narrower than a width of the products and a second portion of the gap between the elongated left side and the elongated right side is wider than or equal to the width of the products.

5. The display device of claim 1, further comprising:

a support member independent of the round base and coupled to the elongated left side and to the elongated right side; and a display panel coupled to the support member.

6. The display device of claim 1, wherein the elongated left side has a left side longitudinal axis and comprises a left side panel with an elongated left side viewing openings having a left side opening longitudinal axis substantially parallel to the left side longitudinal axis, and the elongated right side has a right side longitudinal axis substantially parallel to the left side longitudinal axis and comprises a right side panel separate from the left side panel with an elongated right side viewing opening haying a right side opening longitudinal axis substantially parallel to the right side longitudinal axis, and wherein the left and right side openings allow a line of sight to product retained on the bottom shelf and the round intermediate shelf.

7. The display device of claim 1, wherein the products are substantially circular pillows.

8. A multi-directional display assembly comprising:

a bottom plate;

a plurality of elongated display devices, each of said plurality of elongated display devices being upright and configured to receive product, each of said plurality of elongated display devices facing in a different direction;

an elongated central support post connected substantially at a center of the bottom plate and extending upright from the bottom plate;

an arm independent of the plurality of elongated display devices and extending radially outward from said elongated central support post between adjacent ones of said plurality of elongated display devices, said arm having a distal end; and a rigid product display panel independent of the plurality of elongated display devices and fixedly attached to the distal end of said arm and positioned between the adjacent ones of said plurality of elongated display devices.

9. The multi-directional display assembly of claim 8, wherein the plurality of elongated display devices and the elongated central support post are coupled to the bottom plate with first removable connectors, wherein the arm is coupled to the elongated central support post with a second removable connector and wherein the product display panel is coupled to the elongated central support post with a third removable connector.

10. The multi-directional display assembly of claim 8, wherein said bottom plate has a plurality of curved corners and a recessed portion adjacent each curved corner.

11. The multi-directional display assembly of claim 10, wherein each of the plurality of elongated display devices is received in a respective one of the recessed portions.

12. The multi-directional display assembly of claim 8, wherein said product display panel is configured to receive further product for display.

13. The multi-directional display assembly of claim 8, wherein the product is substantially circular pillows.

14. The display device of claim 4, wherein the second portion of the gap is proximate a low end of the slanted top surface of the round intermediate shelf, and wherein the low end of the slanted top surface of the round intermediate shelf includes a lip.

15. The display device of claim 1, wherein said elongated left side has a continuous front leading left side edge with a left side access and said elongated right side has a continuous front leading right side edge with a right side access, wherein said left side access is aligned with said right side access, and further comprising a gap between said front leading left side edge and said front leading right side edge, said gap being substantially wider at said left side access and said right side access whereby product is retained by the front leading left side edge and the front leading right side edge but can pass through the left side access and right side access.

16. The display device of claim 15, wherein the left and right side accesses are aligned just above said intermediate shelf.

17. The display device of claim 15, wherein the left and right side accesses are aligned just below said intermediate shelf.

18. The display assembly of claim 8, wherein said arm comprises a first arm, said distal end comprises a first distal end, and said product display panel comprises a first product display panel, said display assembly further comprising a second arm independent of said first arm and the plurality of elongated display devices and extending radially outward from said elongated central support post between the adjacent ones of said plurality of elongated display devices and vertically aligned with the first arm said second arm having a second distal end fixedly attached to said first product display panel and positioned between the adjacent ones of said plurality of elongated display devices.

* * * * *